United States Patent [19]

Suzuki et al.

[11] Patent Number: 5,029,508

[45] Date of Patent: Jul. 9, 1991

[54] MUSICAL-TONE-CONTROL APPARATUS

[75] Inventors: Hideo Suzuki; Masao Sakama, both of Hamamatsu, Japan

[73] Assignee: Yamaha Corporation, Hamamatsu, Japan

[21] Appl. No.: 562,457

[22] Filed: Aug. 2, 1990

Related U.S. Application Data

[63] Continuation of Ser. No. 352,560, May 16, 1990, abandoned.

[30] Foreign Application Priority Data

May 18, 1988 [JP] Japan ..... 63-121486
May 18, 1988 [JP] Japan ..... 63-121487
May 18, 1988 [JP] Japan ..... 63-121488

[51] Int. Cl.[5] ..... G10H 1/18

[52] U.S. Cl. ..... 84/616; 84/734; 84/742

[58] Field of Search ..... 84/600, 615, 616, 653, 84/654, 678, 681, 723, 734, 742

[56] References Cited

U.S. PATENT DOCUMENTS 4,635,516 1/1987 Giannini ..... 84/1.01
4,905,560 3/1990 Suzuki et al. ..... 84/600
4,920,848 5/1990 Suzuki et al. ..... 84/600

OTHER PUBLICATIONS

Published European Application No. 264,782 to Hiyoshi et al., 4/1988.

*Primary Examiner*—W. B. Perkey
*Attorney, Agent, or Firm*—Spensley Horn Jubas & Lubitz

[57] ABSTRACT

A musical-tone-control apparatus having finger sensors that detect the bending of each finger and produce on/off signals in response to the bending. One group of outputs of the finger sensors is converted into keycodes that control tone pitches by the use of converting rules, and the other group of the outputs thereof is also used for changing the ranges of the tone pitches. Hence, musical tones controlled by finger motions of a performer are generated. Moreover, the converting rules can be altered by a modification-control means so that keycode-conversion rules can be varied. Thus, conversion rules appropriate for generating tones which occur frequently and are easy to produce for an individual, can be set for each musical piece. Furthermore, grouping the outputs of finger sensors makes it possible for a performer to achieve a variety of control of musical tones.

29 Claims, 8 Drawing Sheets

| KEY | $C_3$ $C_3^{\#}$--- $B_3$ $C_4$---$C_5$--- $C_6$ --- |
|---|---|
| KEY-CODE | 48 49 --- 59 60 ---72 --- 84--- |

MUSICAL-TONE-CONTROL APPARATUS

This is a continuation of copending application Ser. No. 352,560, filed on May 16, 1990, now abandoned.

BACKGROUND OF THE INVENTION

1. Field of the Invention

The present invention relates to a musical-tone-control apparatus preferably used for generating and controlling various musical tones according to the bending of fingers (all the digits of the hand).

2. Prior Art

Performance of conventional musical instruments, whether the instruments are acoustic or electronic, is carried out by operating keyboards, or by blowing pipes, or by plucking strings, etc..

These conventional musical instruments restrict the performer's position, posture and movement during performance because the instruments must be used in a specific manner.

SUMMARY OF THE INVENTION

It is therefore an object of the invention to provide a musical-tone-control apparatus that can free a performer from the restrictions of position, posture and movement during performance, and which also can allow the performer to control musical tones freely.

It is another object of the invention to provide a musical-tone-control apparatus that can freely change the mode of control of musical tones so that the apparatus is in accordance with the characteristics of a performer and/or a piece of music.

In a first aspect of the present invention, there is provided a musical-tone-control apparatus comprising: a plurality of finger sensors which detect the movement of each finger independently; converting means for converting an output signal of each of the finger sensors into a keycode belonging to a first group by use of preset converting rules; modification-control means for changing the converting rules so that the output signal of each finger sensor is converted into a keycode belonging to a second group; and selecting means for selecting either the converting means or the modification-control means, the selecting means supplying the outputs of the finger sensors to the selected one.

In a second aspect of the present invention, there is provided a musical-tone-control apparatus comprising: a plurality of finger sensors, each of which is worn on a finger and is turned on when the finger is bent more than a predetermined angle; an angle sensor which is worn at a performer's joint and which produces a detecting signal proportional to a bending angle of the joint; tone-pitch-generating means for generating tone-pitch data according to outputs of the finger sensors; and tone-parameter-generating means for generating tone parameters which control a peak or an envelope of waveforms of musical tones to be generated according to the detecting signal of the angle sensor.

In a third aspect of the present invention, there is provided a musical-tone-control apparatus comprising: a plurality of finger sensors each of which independently detects the bending of a finger; grouping means that groups the finger sensors into at least two groups; tone-range-setting means for setting a tone range in response to outputs of finger sensors belonging to one of the groups; and tone-pitch-control means for controlling tone pitches of musical tones in the tone range set by the tone-range-setting means in response to outputs of finger sensors belonging to another group.

DESCRIPTION OF THE PREFERRED EMBODIMENTS

The invention will now be described with reference to the accompanying drawings.

[A] FIRST EMBODIMENT

CONFIGURATION OF THE FIRST EMBODIMENT

Figure 1:
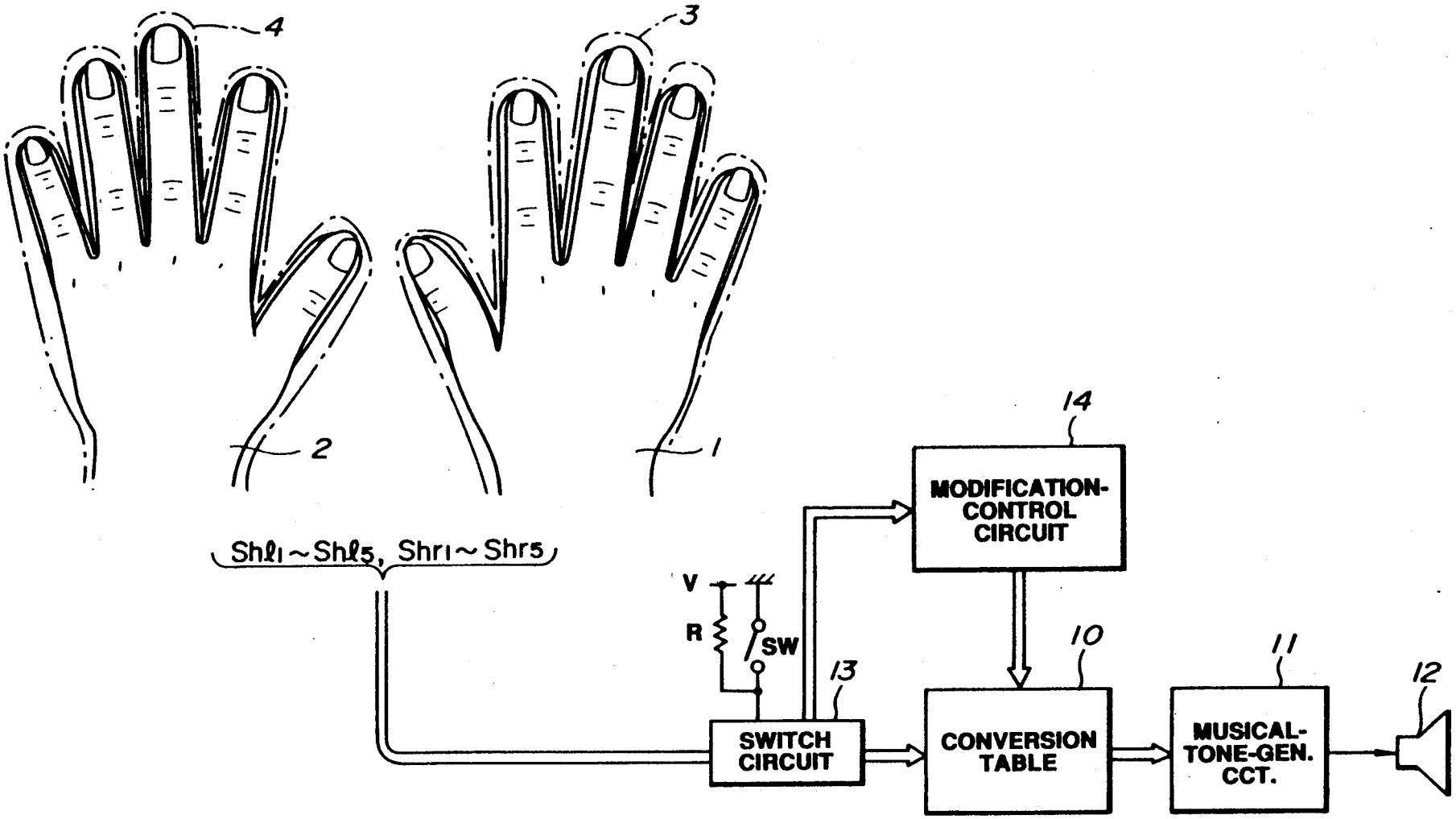
FIG. 1 is a block diagram of a musical-tone-control apparatus according to a first embodiment of the present invention.

FIG. 1 is a block diagram showing a configuration of the first embodiment of the present invention. In FIG. 1, numeral 1 designates the right hand, on which glove-shaped detector 3 is worn, and numeral 2 designates the left hand, on which a similar detector 4 is worn. These detectors 3 and 4 are provided with sensors for detecting the bending of fingers.

Figure 2:
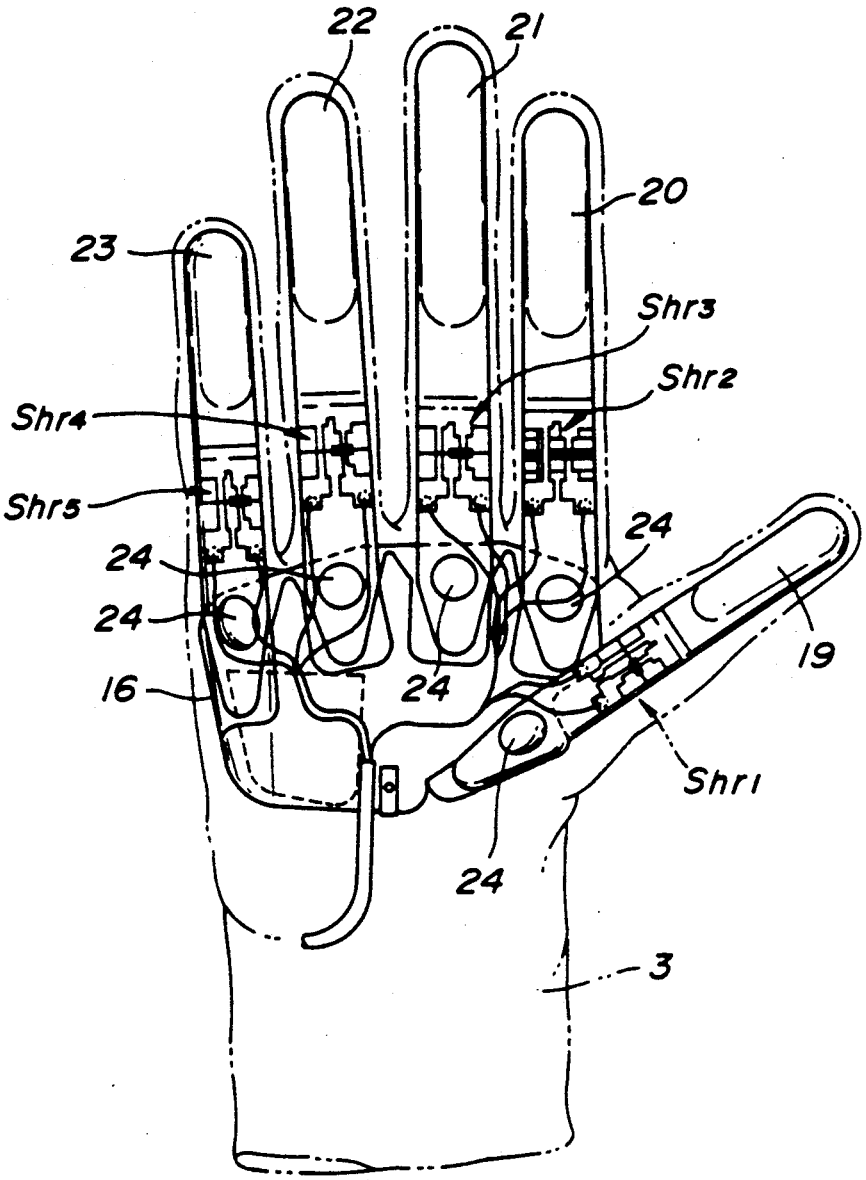
FIG. 2 is a plan view showing a configuration of detector 3 used in the first embodiment.

FIG. 2 shows a configuration of right-hand detector 3. Each numeral 19 to 23 designates a finger splint made of resin formed in a thin plate to conform to the shape of each finger. Each finger split 19 to 23 is provided with a hinge (see FIG. 3A and also 3B) positioned at the second finger joint so that the finger can be bent freely at the hinge. At each of the hinges, there is provided a finger sensor Shri (i=1 to 5) which is activated when the finger is bent to a certain extent, and which switches off when the finger is straightened. Numeral 16 designates a support member which approximately conforms to the shape of the palm. Each of the finger splints 19 to 23 is attached by pin 24, 24 . . . to support member 16.

Next, finger sensor Shri will be described.

Figure 3A:
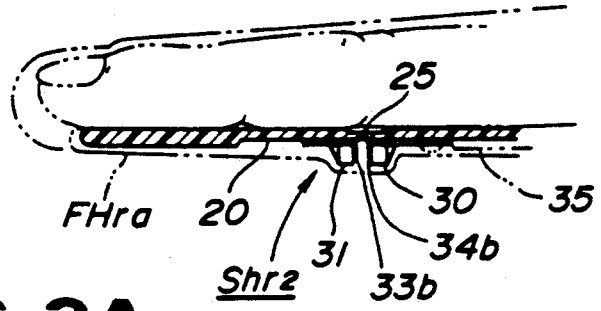
FIGS. 3A and 3B are sectional side elevations showing a finger detector used in the first embodiment.

FIG. 3A is a sectional view showing a construction of the index-finger sensor Shr2. Since the other finger sensors are of similar construction, only the index-finger sensor will be described.

Figure 3B:
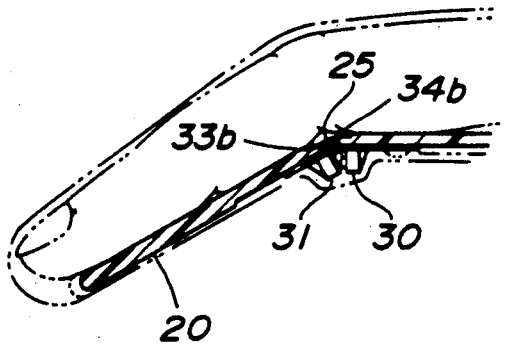

In FIG. 3A, numeral 25 designates a hinge at which finger splint 20 bends. On each side of hinge 25, there is provided a pair of blocks 30 and 31 protruding away from the finger. Block 30 is provided with electrode 34*b* on the interior surface thereof, and block 31 is provided with electrode 33*b* on the interior surface thereof. These electrodes 33*b* and 34*b* make contact when the index finger is bent as shown in FIG. 3B, and hence finger sensor Shr2 is activated. Similarly, each of the finger sensors Shr1 to Shr5 turns on when the corresponding finger is bent to a predetermined extent.

Switch circuit 13 shown in FIG. 1 selectively supplies output signals of finger sensors Shr1 to Shr5 and Sh11 to Sh15 to either conversion table 10 or modification-control circuit 14: when switch SW is on (MODE 0), the output signals are supplied to conversion table 10, whereas when switch SW is off (MODE 1), the output signals are supplied to modification-control circuit 14.

Conversion table 10 receives ON-signals R1 to R5 and L1 to L5 from finger sensors Shr1 to Shr5 and Sh11 to Sh15 via switch circuit 13.

Figure 4:
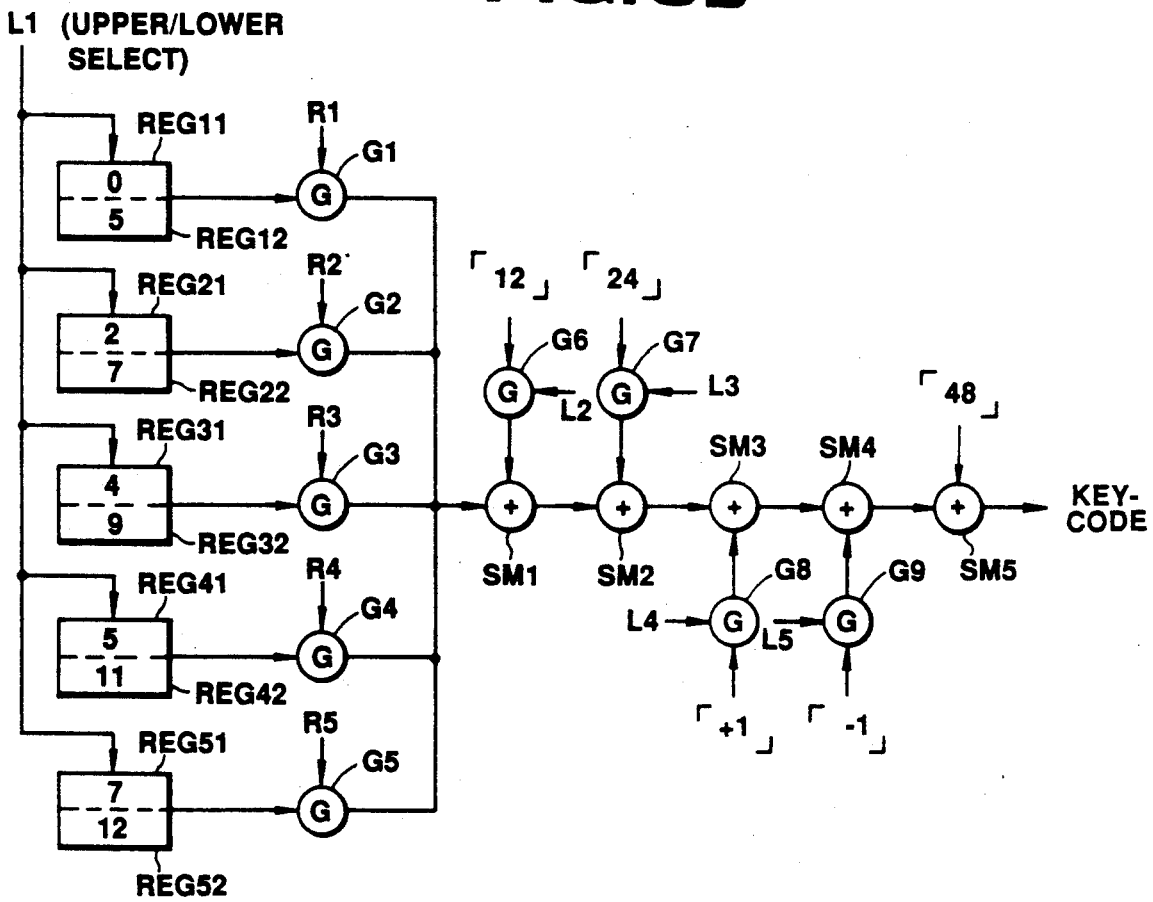
FIG. 4 is a lock diagram showing a configuration of a conversion table of the first embodiment.
Figures 5, 6:
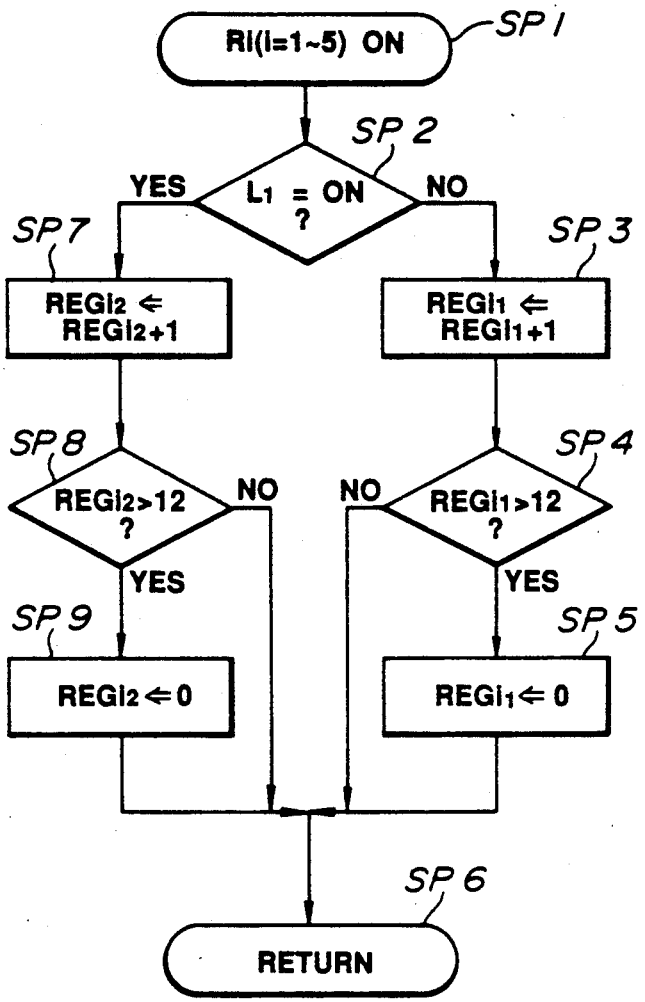
FIG. 5 is a table showing the relationship between keys and keycodes in the first embodiment.
FIG. 6 is a flowchart showing the operation of modification-control circuit 14 in the first embodiment.

FIG. 4 shows a configuration of conversion table 10. In FIG. 4, REGi1 (i=1, 2, . . . 5) and REGi2 designate registers, each of which is initialized to a value shown in FIG. 4. When selection signal L1 (which is produced when the left thumb is bent) is supplied, registers REGi2 are selected, whereas when selection signal L1 is not supplied, registers REGi1 are selected. Gi is a gate which opens when signal Ri is supplied. SM1 to SM4 are adders serially connected, and add values supplied via gates G6 to G9 to values applied to input terminals of adders SM1 to SM4, respectively. More specifically, each of gates G6 to G9 is supplied with one of the values "12", "24", "1", or "−1", and opens when corresponding signal Lk (k=2 to 5) is applied from left finger sensors Sh12 to Sh15. Here, a value "12" corresponds to 12 semitones or an octave step up: "24" to 24 semitones or 2-octave steps up; "1" to a semitone step up, "−1" to a semitone step down. An output signal of adder SM4 is applied to adder SM5 where the output is added to a value of "48" and the resultant value is produced as a keycode. The keycode is a code that specifies a key such as C, D, E, F, G, etc., and whose value changes by 1 for every semitone as shown in FIG. 5. In the first embodiment, the keycode of C3 tone is determined to be "48".

Modification-control circuit 14 comprises a CPU (Central Processing Unit), a program memory, and a work memory. It rewrites the contents of registers REGi1 and REGi2 shown in FIG. 4 in MODE 1. The rewriting operation will be described later.

Musical-tone-generating circuit 11 in FIG. 1 generates musical-tone signals of pitches corresponding to keycodes serially supplied from conversion table 10. The musical-tone signals are supplied to speaker 12 and are produced as musical tones.

OPERATION OF THE FIRST EMBODIMENT

The opration of the first embodiment will be described now.

(1) MODE 0

First, switch SW is turned on so that MODE 0 is set. Next, either a register-REGi1 group or a register-REGi2 group is selected by selection signal L1. The register-REGi1 group is called group 1 and the register-REGi2 group is called group 2. When signal L1 is off, i.e., when the left thumb is straightened, group 1 is selected. In this case, when one of the fingers of the right hand is bent, finger sensor Shri corresponding to the bent finger is turned on, signal Ri is supplied to the corresponding gate Gi and opens it, and hence the content of register REGi1 (one of the values "0", "2", "4", "5" or "7") is supplied to adder SM1 via gate Gi. If the other fingers of the left hand are straightened, selection signals L2 to L5 are not produced, and so the output from gate Gi is supplied to adder SM5 where the value "48" is added thereto, and the resulting sum at adder SM5 is produced as a keycode. As a result, one of the keycodes corresponding to C3, D3, E3, F3, G3 is produced. When group 2 is selected in this case, one of keycodes F3, G3, A3, B3, C4 is produced from adder SM5.

When the left index finger is bent so that finger sensor Sh12 is activated, signal L2 is produced, and gate G6 is opened. As a result, the value "12" is added to the output of gate Gi at adder SM1. This means that the output is shifted (stepped up) by an octave (i.e., 12 semitones). Thus, when group 1 is selected, one of the keycodes corresponding to C4, D4, E4, F4, G4 is produced from adder SM5, whereas when group 2 is selected, one of the keycodes corresponding to F4, G4, A4, B4, C5 is produced from adder SM5.

When the left middle finger is bent, finger sensor Sh13 turns on and signal L3 is produced, so that the value "24" is added to the output of adder SM1 at adder SM2. This means that the output of adder SM1 is shifted (stepped up) by 2 octaves (24 semitones) because the value "24" is added instead of "12" associated with an octave shift.

When the left ring finger or the little finger is bent, and finger sensor Sh14 or Sh15 turns on, selection signal L4 or L5 is provided so that the value "1" or "−1" is added to the output of adder SM2 at adder SM3 or SM4. When the value "1" is added at adder SM3, the output of adder SM2 is stepped up by a half step (semitone), whereas when the value "−1" is added at adder SM4, the output is stepped down by a half step. Hence, when a D3 tone is applied to the input terminal of adder SM3, for example, a keycode corresponding to D3 sharp is produced from the output terminal of adder SM3. In contrast, when a keycode corresponding to D3 is supplied to the input terminal of adder SM4, a keycode corresponding to D3 flat is provided from the output terminal thereof.

The following tables summarize the conversions described above. First, right finger sensors Shr1 to Shr5 indicate notes as shown in TABLE 1, where the mark "*" indicates the corresponding note in the next octave up.

TABLE 1

| | group 1 | group 2 |
|---|---|---|
| Shr1 | C | F |
| Shr2 | D | G |
| Shr3 | E | A |
| Shr4 | F | B |
| Shr5 | G | C* |

According to the example of TABLE 1, the movements of the right fingers corresponds to those of a performance on a keyboard.

Next, ON-signals L1 to L5 produced from left finger sensors Sh11 to Sh15 indicate various modification processes shown in TABLE 2.

TABLE 2

| | process | keycode algorit |
|---|---|---|
| Sh11 | group selection i | ±0/+5 or +6 |
| Sh12 | 1 octave up | +12 |
| Sh13 | 2 octaves up | +24 |
| Sh14 | sharp | +1 |
| Sh15 | flat | −1 |

Finally, TABLE 3 shows a range of keycodes generated by combinations of left finger sensors Sh11 to Sh13 and right finger sensors Shr1 to Shr5: combinations of ON/OFF of sensors Sh11 to Sh13 and ON of one of the sensors Shr1 to Shr5. A mark "-" indicates a "don't care" condition.

TABLE 3

| left hand | | | right hand |
|---|---|---|---|
| Sh13 | Sh12 | Sh11 | Shr1 to Shr5 |
| OFF | OFF | OFF | C3 to G3 |
| OFF | OFF | ON | F3 to C4 |
| OFF | ON | OFF | C4 to G4 |
| OFF | ON | ON | F4 to C5 |
| ON | — | OFF | C5 to G5 |
| ON | — | ON | F5 to C6 |

As described above, in MODE 0, a keycode is sequentially generated from conversion table 10 according to combinations of the finger bending as shown in TABLE 1 to 3, and a musical tone corresponding to the keycode is sequentially produced from speaker 12.

(2) MODE 1

In MODE 1, initial values of registers REGi1 and REGi2 can be altered to arbitrary values.

MODE 1 is entered by turning switch SW off as shown in FIG. 1, so that the output signals from finger sensors Shr1 to Shr5 and Sh11 to Sh15 are supplied to modification-control circuit 14. Modification-control circuit 14 handles ON-signals Ri (i=1 to 5) from right finger sensors Shr1 to Shr5 as shown in a flowchart in FIG. 6, when one of the signals Ri is supplied thereto (step SP1). At step SP2, modification-control circuit 14 tests whether signal L1 is provided (i.e., ON) or not. The test corresponds to determine which group, group 1 (register-REGi1 group) or group 2 (register-REGi2 group), is selected. If the test result at step SP2 is "NO", that is, register REGi1 group is selected, modification-control circuit 14 increments the content of register REGi1 by 1 at step SP3. For example, the content of register REG11 is incremented from "0" to "1", when the right index finger is bent and so signal R1 is supplied. Completing step SP3, modification-control circuit 14 proceeds to step SP4, and tests whether the value of register REGi1 exceeds "12" or not. If the test result is "NO", modification-control circuit 14 exits the routine at step SP6 and finishes the process. In contrast, when the test result at step SP4 is "YES", modification-control circuit 14 proceeds to step SP5 where it resets register REGi1 to "0" and exits the routine at step SP6. The processes at steps SP4 and SP5 is to limit the changing range in value of register REGi1 within an octave.

If signal Ri is provided again after completing the above processes, these processes from step SP1 to step SP6 are repeated. When signal Ri of the same number i is provided repeatedly, register REGi1 associated therewith is incremented successively. For example, if signal R1 is provided repeatedly, the content of register REG11 is incremented such as "0, 1, 2, 3", etc.. Consequently, when MODE 0 operation is performed after MODE 1 operation is completed, keycodes are generated according to the altered values of registers REGi1 and REGi2. For example, as the content of register REG11 is varied "0", "1", "2", "3", etc., a keycode varies C, C sharp, D, D sharp . . . .

When the test result at step SP2 is "YES", i.e., when signal L1 is provided, the contents of resisters REGi2 are incremented in a manner similar to that described above in steps SP7 through SP9.

By changing the contents of registers REGi1 to REGi2, the following advantages are achieved:

(a) When a performance is carried out, with initial values of registers REGi1 and REGi2 remaining as shown in FIG. 4, the left ring finger or left little finger need not be moved frequently in C major because notes in C major are seldom sharp or flat. These fingers, however, must be moved more frequently in G major because an A tone must be stepped up by a semitone. In such a case, if the initial value of register REG32 is incremented by 1 in advance in MODE 1, an A sharp tone can be produced without moving the left ring finger.

(b) If all the contents of registers REGi1 and REGi2 are incremented or decremented by a constant value, keycodes are shifted all at once so that finger operations can also be shifted.

(c) Generally speaking, the fingers which are easier to move differ from person to person. Hence, the assignment of tones that occur frequently to fingers which are easy to move facilitates a performance.

[B] SECOND EMBODIMENT

Figure 7:
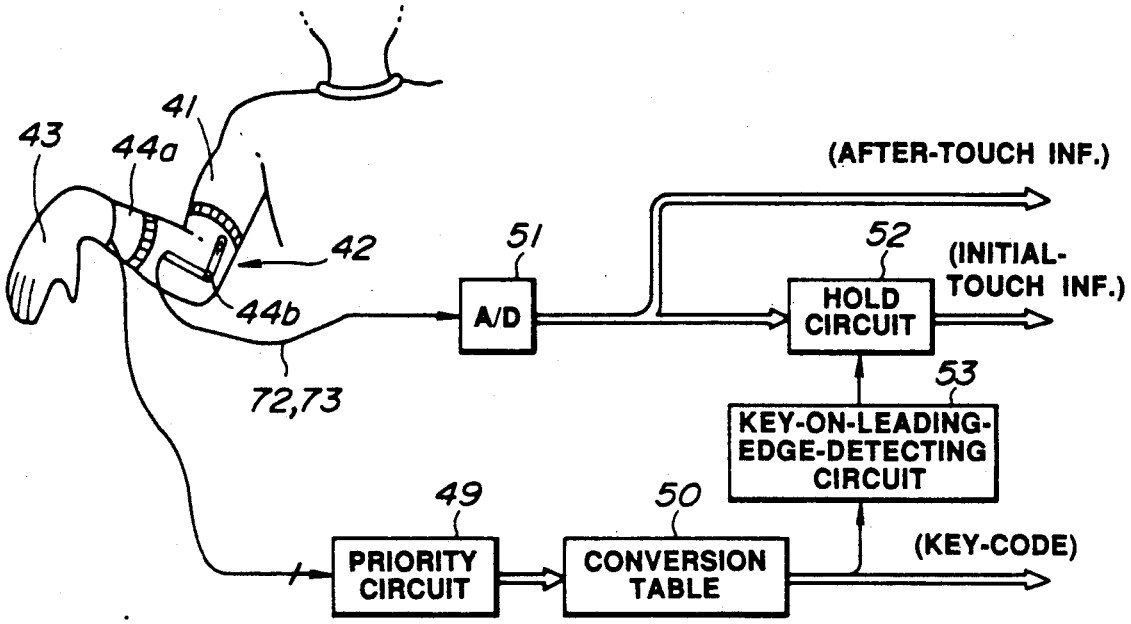
FIG. 7 is a block diagram showing a configuration of a musical-tone-control apparatus according to a second embodiment of the present invention.

FIG. 7 is a block diagram of a musical-tone-control apparatus according to a second embodiment of the present invention.

In FIG. 7, numeral 41 designates the right arm of a performer, numeral 42 designates an angle detector, numeral 43 denotes a glove-shaped detector. Angle detector 42 consists of supporter 44*a* and angle sensor 44*b*, and detects a bending angle of the right elbow of the performer. Detector 43 is provided with finger sensors for detecting the bending of each finger.

The finger sensors have the same construction as shown in FIG. 2, and hence, FIG. 2 and the same numerals therein will be used to describe the third embodiment. Here, a construction of angle detector 42 will be described.

CONFIGURATION OF ANGLE DETECTOR

Figure 8:
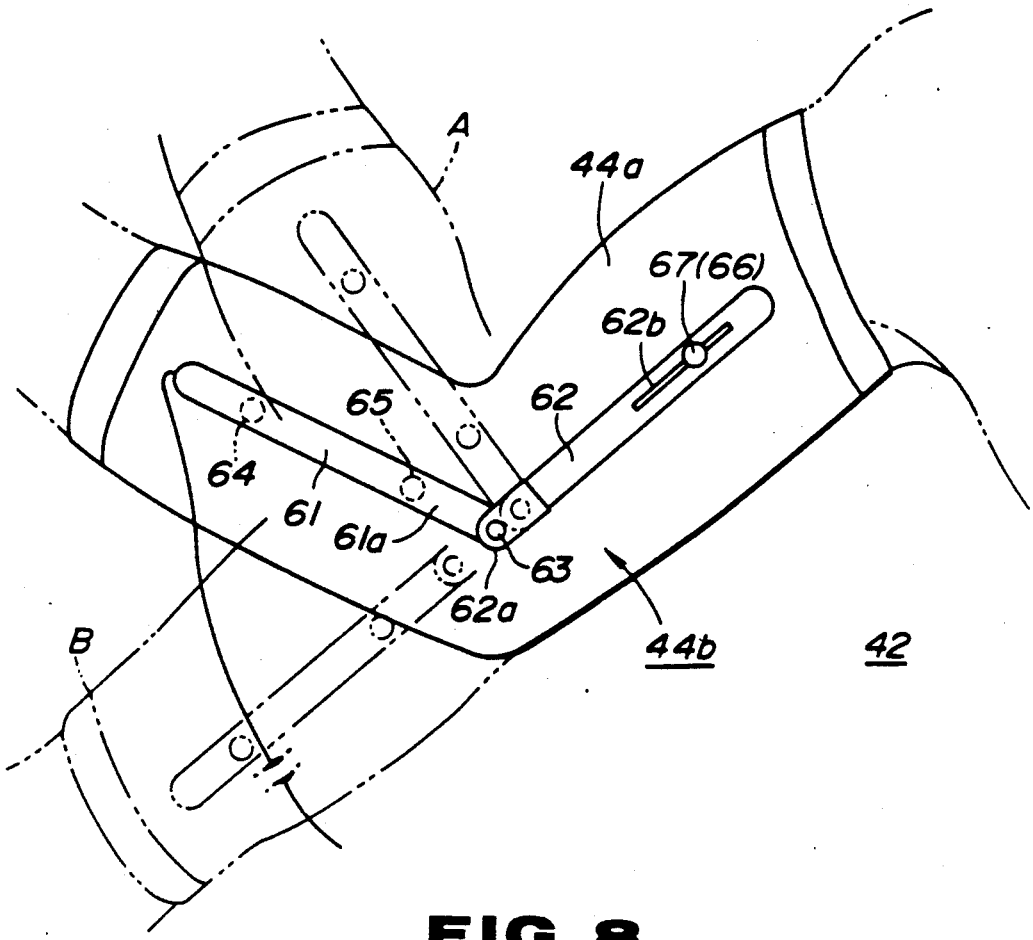
FIG. 8 is a front elevation showing an angle detector worn around the upper arm of a performer.
Figure 9A:
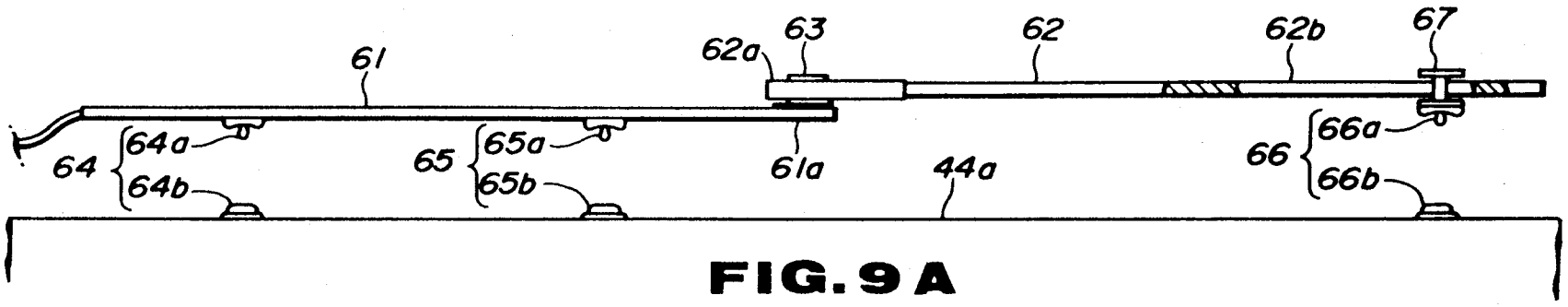
FIG. 9A is a partially broken side elevation of the angle detector.
Figure 9B:
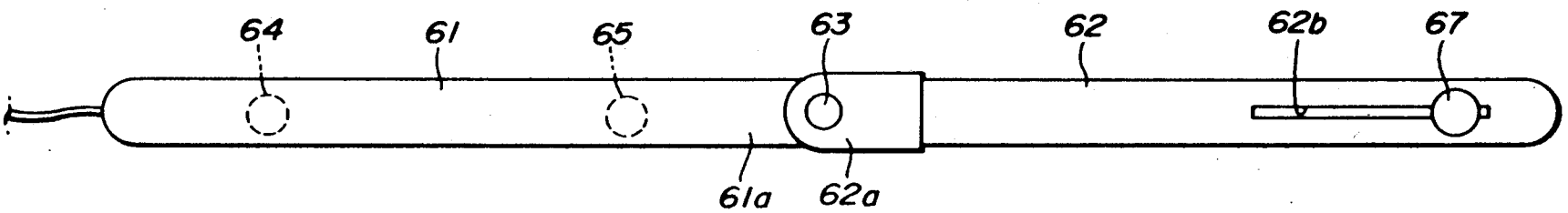
FIG. 9B is a front elevation of the angle detector.

FIG. 8 is a front elevation showing angle detector 42 worn around the upper arm of a performer, FIG. 9A is a partially broken side elevation of angle detector 42, and FIG. 9B is a front elevation thereof.

In these Figures, angle detector 42 comprises supporter 44*a* worn around the elbow joint portion of the player's right arm, and angle sensor 44*b* is removably attached to supporter 44*a*. Angle sensor 44*b* has two links 61 and 62 rotatably connected to each other at their ends 61*a* and 62*a* by pin 63. Links 61 and 62 are made of elongated plastic plates or the like of about the same size, and are removably mounted on supporter 44*a*: link 61 is mounted with snaps 64 and 65, whereas link 62 is mounted with snap 66. More specifically, male snaps 64a and 65a of snaps 64 and 65 are attached to the back of link 61, and they are coupled to female snaps 64b and 65b which are attached to supporter 44a. On the other hand, male snap 66a of snap 66 is attached to the back of guide member 67 which is slidably inserted lengthwise in slot 62b provided in link 62, and male snap 66a is coupled to female snap 66b attached to supporter 44a.

Figure 10:
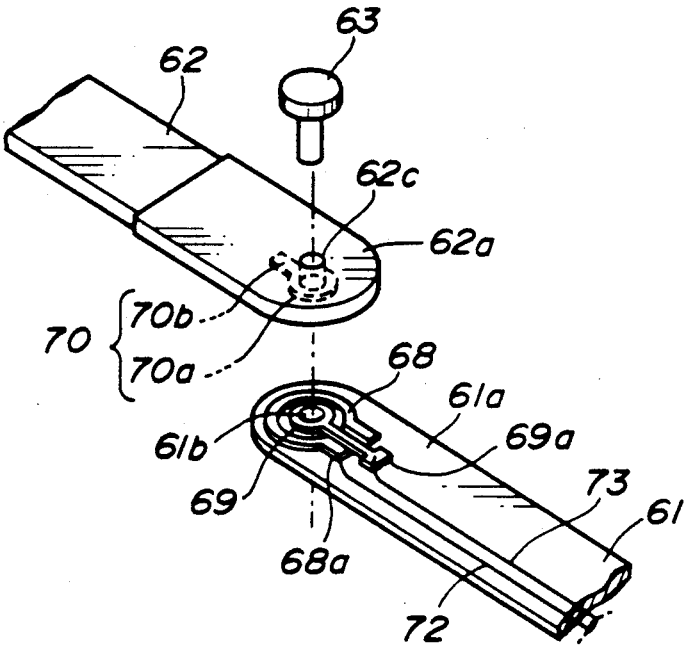
FIG. 10 is an exploded perspective view showing the main part of the angle detector.

At the facing ends of links 61 and 62, as shown in FIG. 10, there are provided resistance element 68, fixed contact 69 and sliding contact 70, which together function as a potentiometer. More specifically, at the end of link 61, hole 61b is provided into which pin 63 is inserted and fixed, and concentrically encircling hole 61b there is provided fixed contact 69, and partially circular resistance element 68 which is also formed concentrically around hole 61b. On the other hand, at end 62a of link 62, hole 62c is provided into which pin 63 is loosely inserted, and around hole 62c there is provided sliding contact 70 maintaining contact with resistance element 68 as well as with fixed contact 69. Sliding contact 70 comprises a ring portion 70a which keeps contact with fixed contact 69, and projection 70b which slides on resistance element 68 maintaining contact therewith a links 61 and 62 rotate each other. Lead wire 72 is connected to terminal 68a of resistance element 68, and lead wire 73 is connected to terminal 69a of fixed contact 69.

Angle detector 42, thus constructed, is worn on the player's right arm as shown in FIG. 8. When the player bends his right arm as shown by the alternating long dashed and double short dashed line A in FIG. 8, or straightens it as shown by the alternating long dashed and double short dashed line B, link 61 revolves about pin 63. Accompanying the revolution, projection 70b of sliding contact 70 slides on resistance element 68. As a result, the resistance across terminal 68a of resistance element 68 and terminal 69a of fixed contact 69 varies in response to the displacement of sliding contact 70, that is, the bending angle of the right arm. In this case, motions of the player's arm are free because guide member 67 slides along slot 62b in response to the rotation of link 61 with the bending or straightening of the arm.

ELECTRICAL CONFIGURATION OF THE SECOND EMBODIMENT

In FIG. 7, numeral 49 designates a priority circuit in which the order for processing outputs of right finger sensors Shr1 to Shr5 and left finger sensors Sh11 to Sh15 is determined according to an arrival order of the outputs. Numeral 50 designates a conversion table consisting of a logical-operation circuit or ROM (Read Only Memory), and serially produces keycodes by decoding outputs of finger sensors Shr1 to Shr5 and Sh11 to Sh15 supplied via priority circuit 9, according to predetermined rules. The construction of conversion table 50 is the same as that of conversion table 10 in FIG. 1 and FIG. 4, and performs the operations shown in TABLE 1 though TABLE 3, hence the description thereof will be omitted here.

In FIG. 7, numeral 51 designates an A/D (Analog-to-Digital) converter that converts an analog signal, which is produced across terminals 68a and 69a of angle sensor 44b shown in FIG. 10, into a digital signal. The digital signal produced from A/D converter 51 is outputted as after-touch information, and is also supplied to hold circuit 52 Hold circuit 52 loads the digital signal from A/D converter 51 when a signal is applied from key-on-leading-edge-detecting circuit 53 which supplies the signal to hold circuit 52 each time conversion table 50 produces a new keycode. The signal loaded to hold circuit 52 is maintained therein and is outputted as initial-touch information. The initial-touch information indicates the touch information at the starting portion of operations of the movable members of the apparatus, and it corresponds, for example, to the key-velocity when a key is depressed in a keyboard instrument. In contrast, the after-touch information corresponds, for example, to the key pressure after the key has been depressed.

The initial-touch and after-touch information, as well as the keycode are supplied to a musical-tone-control circuit (not shown), so that a peak value, attack portion, decay portion, and sustain portion of a tone wave envelope to be generated are controlled.

According to the second embodiment, keycodes specified by rules shown in TABLE 1 to TABLE 3 are serially produced from conversion table 50, and musical tones associated with the keycodes are produced from the musical-tone-control circuit. Those tones have wave envelopes defined by the initial-touch and after-touch information which correspond to the bending angle of the elbow. Thus, the performer can control musical tones by bending fingers and/or elbows.

Figure 11:
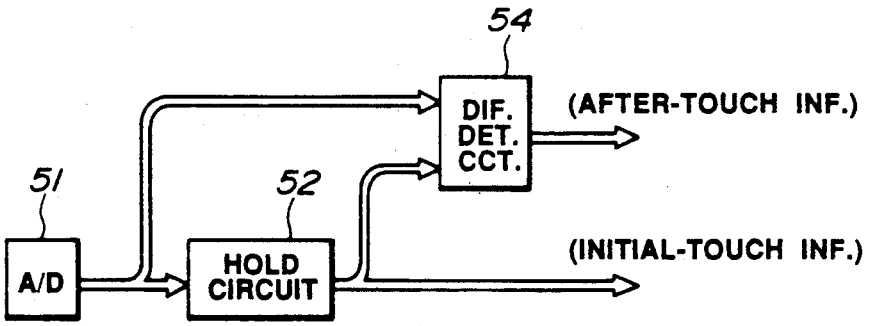
FIG. 11 is a block diagram showing a modification of the second embodiment.

FIG. 11 shows a modified circuit for generating the after-touch information. In FIG. 11, numeral 54 designates a difference-detecting circuit that determines the difference between signals supplied from A/D converter 51 and from hold circuit 52, thus producing the difference as the after-touch information. This construction presents more natural and real after-touch information because the after-touch information is modified by the initial-touch information.

[C] THIRD EMBODIMENT

Figure 12:
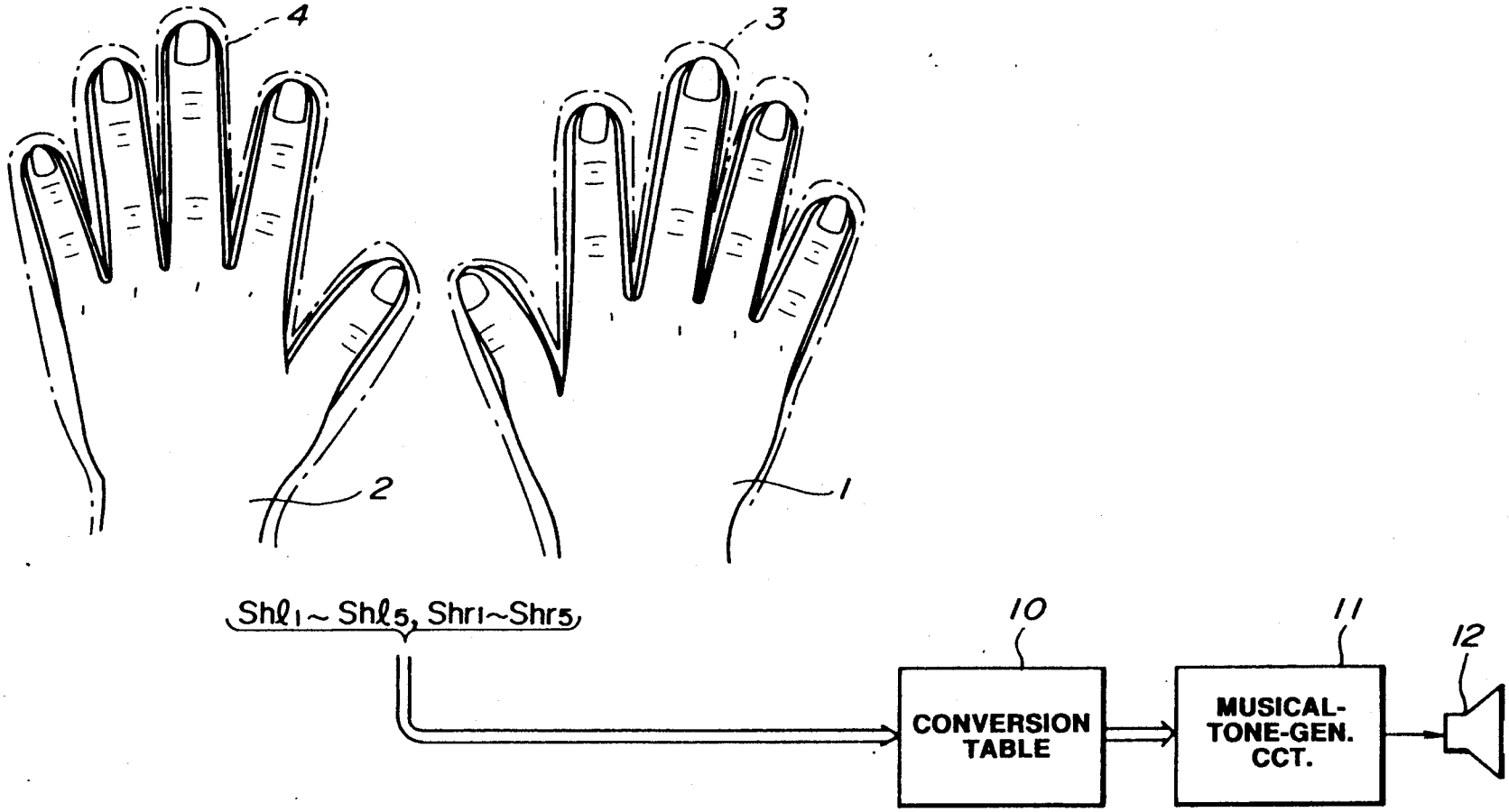
FIG. 12 is a block diagram of a musical-tone-control apparatus according to a third embodiment of the invention.

FIG. 12 is a block diagram of a musical-tone-control apparatus according to a third embodiment of the invention. In FIG. 12, like reference numerals designate like parts as in FIG. 1. In the third embodiment, the output signals from finger sensors Shr1 to Shr5 and Sh11 to Sh15 are directly supplied to conversion table 10. Conversion table 10 in FIG. 12 has the same construction as conversion table 10 in FIG. 1, and performs the operations specified in TABLE 1 to TABLE 3, thus sequentially converting the outputs of finger sensors Shr1 to Shr5 and Sh11 to Sh15 to keycodes. The keycodes serially produced from conversion table 10 are applied to musical-tone-generating circuit 11. Musical-tone-generating circuit 11 generates musical-tone signals corresponding to the keycodes, amplifies the signals and supplies them to speaker 12.

According to the third embodiment, keycodes specified by bent fingers, and by the rules shown in TABLE 1 to TABLE 3, are serially produced from conversion table 10, and musical tones associated with the keycodes are produced from speaker 12.

Figure 13B:
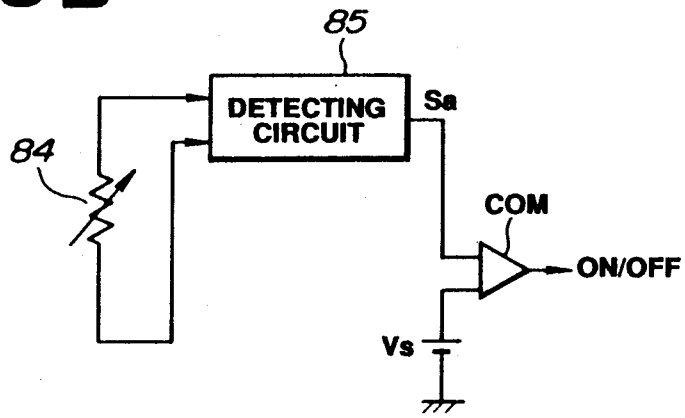
FIG. 13B is a block diagram showing the electrical configuration of the finger sensor.
Figure 13A:
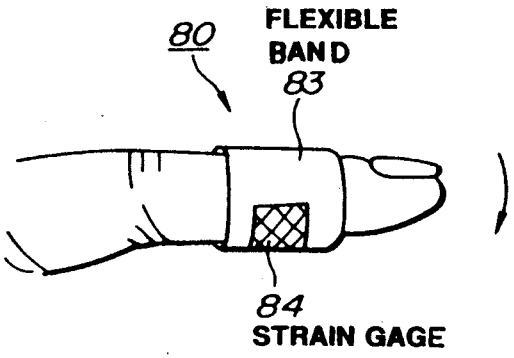
FIG. 13A is a schematic view showing another finger sensor used in the third embodiment.

The finger sensors described above can be replaced by other types of finger sensors. For example, finger sensor 80 shown in FIG. 13A can be used. Finger sensor 80 comprises flexible band 83 worn around a finger, and strain gage 84 attached to band 83. The change of electrical resistance of a wire in strain gage 84 is detected by detecting circuit 85 in FIG. 13B, and the detection signal Sa produced therefrom is compared with reference voltage Vs by comparator COM. The output of comparator 85 is used as the ON/OFF signal from the finger detector.

Although specific embodiments of a musical-tone-control apparatus constructed in accordance with the present invention have been disclosed, it is not intended that the invention be restricted to either the specific configurations or the uses disclosed herein. Modifications may be made in a manner obvious to those skilled in the art as, for example, in the following ways:

(a) Although the values of registers in conversion circuit 10 of the first embodiment can be altered within an octave, it is possible to modify it so that the values can be changed by more than an octave.

(b) In the first embodiment, only the values in registers of conversion table 10 corresponding to the right finger sensors can be rewritten. However, it is possible to modify this so that the values corresponding to the left finger sensors can also be rewritten.

(c) Modification-control circuit 14 in the first embodiment can be designed in other configurations. For example, it may be provided with a number of conversion tables so that any one of the tables may be selected.

(d) Although the right fingers are used for designating tone pitches and the left fingers are used for designating tone ranges, the designation of the functions of the fingers are arbitrary, and so functions can be easily reassigned. For example, the functions may be switched among groups. Moreover, grouping into more than three groups is possible. Furthermore, ON/OFF signals produced by the finger sensors can be used for achieving tone effect such as vibrato or for switching tone colors.

(e) Although the first and third embodiments are designed to generate only monotones, they can also be altered to generate and control chords. For example, conversion table 10 can be designed to recognize tone pitches designated by the right fingers as roots and the bending of the left fingers as indication of types of chords such as a minor or seventh, so that the control of accompaniment can be achieved.

(f) Although the second embodiment detects the bending angle of the elbow, other bending angles can be used to control musical tones; for example, the bending angles of the wrist, knee, or between upper arm and shoulder can be used.

(g) A switch for switching the after-touch information, and the switch for switching the initial-touch information can be added separately, so that these pieces of information can be independently switched on or off.

(h) In the second embodiment, after-touch and initial-touch information can be modified by a tone element such as tone color. This is accomplished, for example, by providing a conversion table that includes many constants of different values according to tone colors, and by multiplying after-touch and/or initial-touch information by one of the table constants.

(i) Any sensors that can detect the bending of fingers or the bending angle of a joint can be used instead of the finger sensors or angle sensors described above.

(j) Although, the conversion table is constructed by logic circuits in the embodiments, the conversion tables in the second and third embodiments can be contained in ROM or RAM. In that case, the ROM or RAM receives address data generated by decoding the outputs of the finger sensors, and produces a keycode corresponding to the address data.

(k) The apparatuses of the embodiments mentioned above control a peak or an envelope of waveforms of musical tones to be generated according to the detecting signal of the angle sensor. However, the detecting signal of the angle sensor can be used for controlling a tone color of musical tones.

Accordingly, it is intended that the invention be limited only by the scope of the appended claims.

What is claimed is:

1. A musical-tone-control apparatus comprising:

a plurality of finger sensors which detect the movement of each finger independently;

converting means for converting an output signal of each of said finger sensors into a keycode belonging to a first group by use of preset converting rules;

modification-control means for changing said converting rules so that the output signal of each of said finger sensors is converted into a keycode belonging to a second group; and selecting means for selecting either said converting means or modification-control means, said selecting means supplying said outputs of said finger sensors to the selected one.

2. A musical-tone-control apparatus according to claim 1, wherein said converting means comprising:

storing means for storing numbers representing notes;

gating means for gating said numbers stored in said storing means in response to outputs of said finger sensors;

adding means for adding predetermined numbers to outputs of said gating means in response to said outputs of said finger sensors.

3. A musical-tone-control apparatus according to claim 2, wherein said storing means includes a plurality of groups of said numbers, each of said groups able to be selected in response to a certain output of said finger sensors.

4. A musical-tone-control apparatus according to claim 2, wherein said gating means gates said numbers stored in said storing means in response to right finger sensors worn on the fingers of the right hand of a performer.

5. A musical-tone-control apparatus according to claim 4, wherein said adding means adds said predetermined numbers in response to left finger sensors worn on the fingers of the left hand of a performer.

6. A musical-tone-control apparatus according to claim 2, wherein said adding means adds a predetermined number to said outputs of said gating means so that said keycode shifts by one semitone.

7. A musical-tone-control apparatus according to claim 2, wherein said adding means adds a predetermined number to said outputs of said gating means so that said keycode shifts by one octave.

8. A musical-tone-control apparatus according to claim 2, wherein said modification-control means rewrites the contents of said storing means in response to said outputs of said finger sensors.

9. A musical-tone-control apparatus according to claim 8, wherein said modification-control means changes said numbers in said storing means so that said keycode associated with each finger is shifted by a semitone in response to each of said outputs of said finger sensors.

10. A musical-tone-control apparatus according to claim 2, wherein said modification-control means rewrites said predetermined numbers applied to said adding means in response to said outputs of said finger sensors.

11. A musical-tone-control apparatus according to claim 1, wherein said converting means comprises a plurality of conversion tables contained in a memory, each of said conversion table having address input terminals to which said outputs of said finger sensors are applied, and each of said conversion table having data output terminals from which said keycodes are produced.

12. A musical-tone-control apparatus according to claim 11, wherein said modification-control means selects one of said conversion tables to which said outputs of said finger sensors are applied.

13. A musical-tone-control apparatus comprising:

a plurality of finger sensors each of which is worn on a finger and is turned on when the finger is bent more than a predetermined angle;

an angle sensor which is worn on a performer's joint and which produces a detecting signal based on a bending angle of the joint;

tone-pitch-generating means for generating tone-pitch data according to an output of each finger sensor; and tone-parameter-generating means for generating tone parameters which control a peak of waveforms, an envelope of waveforms, or a tone color of musical tones to be generated according to said detecting signal of said angle sensor.

14. A musical-tone-control apparatus according to claim 13, wherein said tone-pitch-generating means includes converting means that produces keycodes and key-on signals in response to outputs of said finger sensors.

15. A musical-tone-control apparatus according to claim 13, wherein said tone-parameter-generating means maintains said detecting signal of said angle sensor when at least one of said finger sensors turns on, and said tone-parameter-generating means produces said detecting signal held as an initial-touch parameter.

16. A musical-tone-control apparatus according to claim 13, wherein said tone-parameter-generating means produces said detecting signal of said angle sensor as an after-touch parameter.

17. A musical-tone-control apparatus according to claim 15, wherein said tone-parameter-generating means produces the difference between said detecting signal held in said tone-parameter-generating means and the current detecting signal of said angle sensor, and outputs said difference as an after-touch parameter.

18. A musical-tone-control apparatus according to claim 13, wherein said tone-parameter-generating means has switching means that can independently turn on or off each of said parameters.

19. A musical-tone-control apparatus according to claim 13, wherein said tone-parameter-generating means includes a plurality of conversion tables each of which converts said detecting signals of said angle sensor into touch parameters according to instruments to be controlled.

20. A musical-tone-control apparatus comprising:

a plurality of finger sensors each of which independently detects the movement of a finger;

grouping means for grouping said finger sensors into at least two groups;

tone-range-setting means for setting a tone range in response to finger sensors belonging to one of said groups;

keycode generating means for generating a keycode in response to each finger sensor belonging to another of said groups, wherein said each finger sensor corresponds to a keycode in said tone range; and tone-pitch-control means for controlling tone pitches of musical tones based on said tone range set by said tone-range-setting means and said keycode generated by said keycode generating means.

21. A musical-tone-control apparatus according to claim 20, wherein said grouping means divides said finger sensors into two groups, one of which consists of finger sensors of the right hand, and the other of which consists of finger sensors of the left hand.

22. A musical-tone-control apparatus according to claim 20, wherein said grouping means divides said finger sensors into three or more groups, one of which is used for controlling tone characters other than tone pitches and tone ranges, such as tone colors or vibrato.

23. A musical-tone-control apparatus according to claim 20, wherein said tone-range setting means sets types of chords according to the outputs of finger sensors.

24. A musical-tone-control apparatus according to claim 20, wherein each of said finger sensors includes a strain sensor whose resistance changes according to stress exerted thereto fastening means for fastening said strain sensor on a finger, and circuit means for producing an "on" signal or an "off" signal in response to the output of said strain sensor.

25. A musical-tone-control apparatus according to claim 20, wherein said tone-range-setting means and tone-pitch-control means are made of logic circuits.

26. A musical-tone-control apparatus according to claim 20, wherein said tone-range-setting means and tone-pitch-control means are contained in read only memory.

27. A musical-tone-control apparatus comprising:

a plurality of finger sensors each of which independently detects the movement of a finger;

grouping means for grouping said finger sensors into at least two groups;

tone-range-setting means for setting a tone range in response to outputs of finger sensors belonging to one of said groups;

producing means for producing a keycode in said tone range and a key-on signal in response to an output of a finger sensor belonging to another of said groups; and tone-pitch-control means for controlling tone pitches of musical tones based on said tone range set by said tone-range-setting means and said keycode produced by said producing means.

28. A musical-tone-control apparatus comprising:

a plurality of finger sensors each of which is worn on a finger and is turned on when the finger is bent more than a predetermined angle;

an angle sensor which is worn on a performer's joint and which produces a detecting signal based on a bending angle of the joint;

tone-pitch-generating means for generating tone-pitch data according to outputs of said finger sensors; and tone-parameter-generating means for generating tone parameters which control a peak of waveforms or an envelope of waveforms of musical tones to be generated according to said detecting signal of said angle sensor.

29. A musical-tone-control apparatus comprising:

a plurality of finger sensors each of which is worn on a finger and is turned on when the finger is bent more than a predetermined angle;

an angle sensor which is worn on a performer's joint and which produces a detecting signal based on a bending angle of the joint;

tone-pitch-generating means for generating tone-pitch data according to outputs of said finger sensors; and tone-parameter-generating means for generating tone parameters which control an initial-touch and/or after-tone of musical tones to be generated according to said detecting signal of said angle sensor.

* * * * *